United States Patent [19]

Shingo et al.

[11] Patent Number: 4,627,739

[45] Date of Patent: Dec. 9, 1986

[54] BRACELET TYPE WRIST WATCH

[75] Inventors: Ichikawa Shingo; Hisahide Nakagawa; Hayao Kano; Koji Kudo, all of Tokyo, Japan

[73] Assignee: Citizen Watch Co., Ltd., Tokyo, Japan

[21] Appl. No.: 697,077

[22] Filed: Jan. 31, 1985

[30] Foreign Application Priority Data

| | | | |
|---|---|---|---|
| Feb. 3, 1984 | [JP] | Japan | 59-13987[U] |
| Feb. 3, 1984 | [JP] | Japan | 59-13988[U] |
| Feb. 3, 1984 | [JP] | Japan | 59-13989[U] |

[51] Int. Cl.[4] ..... G04B 37/00

[52] U.S. Cl. ..... 368/282; 368/281; 368/287; 63/5 A

[58] Field of Search ..... 368/281, 282, 283, 276, 368/277, 278, 287; 63/5 A

[56] References Cited

U.S. PATENT DOCUMENTS

| | | | |
|---|---|---|---|
| 204,548 | 6/1978 | Durand | 63/5 A |
| 393,595 | 11/1888 | Veatch | 63/5 A |
| 655,025 | 6/1960 | Simon | 63/5 A |
| 4,117,662 | 10/1978 | van der Lely . | |
| 4,178,751 | 12/1979 | Liautaud | 368/282 |
| 4,229,936 | 10/1980 | Schneider et al. . | |

FOREIGN PATENT DOCUMENTS

| | | | |
|---|---|---|---|
| 1381474 | 4/1902 | France | 368/282 |
| 43678 | 6/1908 | Switzerland | 63/5 A |
| 280259 | 1/1952 | Switzerland | 63/5 A |
| 1206595 | 9/1970 | United Kingdom . | |

*Primary Examiner*—Bernard Roskoski

*Attorney, Agent, or Firm*—Spencer & Frank

[57] ABSTRACT

A bracelet type wrist watch composed of a curved body having a watch embedded therein, and a coil spring covering said curved body, thus presenting a neat appearance as an ornamental ring when worn around the wrist.

9 Claims, 13 Drawing Figures

BRACELET TYPE WRIST WATCH

BACKGROUND OF THE INVENTION

The present invention relates to a wrist watch and particularly to a bracelet type wrist watch which is designed to wear around the wrist as an ornament.

As is well known, there are two different kinds of wrist watches classified from the standpoint of time presentation, that is, the analogue type in which time is measured or shown by means of two or three hands moving around a numbered face, and the digital type in which time is measured or shown by means of digits appearing in an electro-optical display.

Small watches are designed to be worn around the wrist by using leather straps, synthetic resin or metal bands in the form of bracelets. Otherwise, watches are designed to be worn around the neck by using chains or straps in the form of a hanging ornament or pendant, or around the ring finger by using circles. Among these different types of wrist watches customers take their choice to fit their suits or dresses. Thus, there are two different aspects of the wrist watch: an instrument for measuring and showing time, and at the same time, an ornament or accessory matching a dress or suit.

Recently the role of the wrist watch as an ornament has become more important than the role of the wrist watch as an instrument for measuring and showing time. There has been an ever increasing demand for unique ornamental design.

SUMMARY OF THE INVENTION

One object of the present invention is to provide a wrist watch of unique ornamental design, while still assuring the ease with which the wrist watch can be worn around the wrist.

Another object of the present invention is to provide a wrist watch which looks like a bracelet, permitting the face of the wrist watch to appear when desired.

To attain these objects a bracelet type wrist watch according to the present invention comprises a curved body having a watch module embedded therein, and a coil spring band to be worn around the wrist, accommodating said curved body.

BRIEF DESCRIPTION OF THE DRAWINGS

Other objects and advantages of the present invention will be understood from the accompanying drawings in which preferred embodiments of the present invention are shown.

DETAILED DESCRIPTION OF THE PREFERRED EMBODIMENTS

Figure 1:
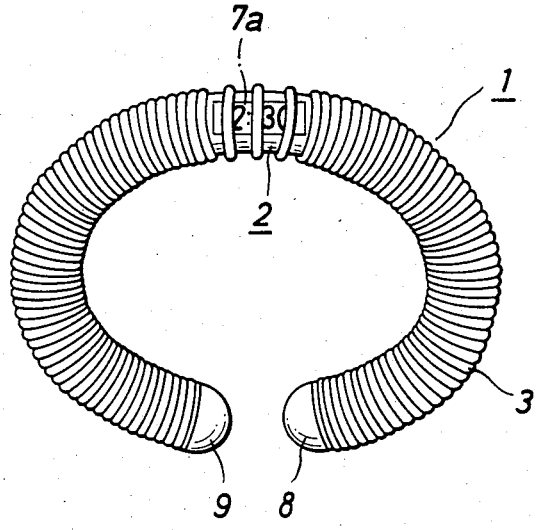
FIG. 1 is a perspective view of a bracelet type wrist watch according to a first embodiment of the present invention.
Figure 2:
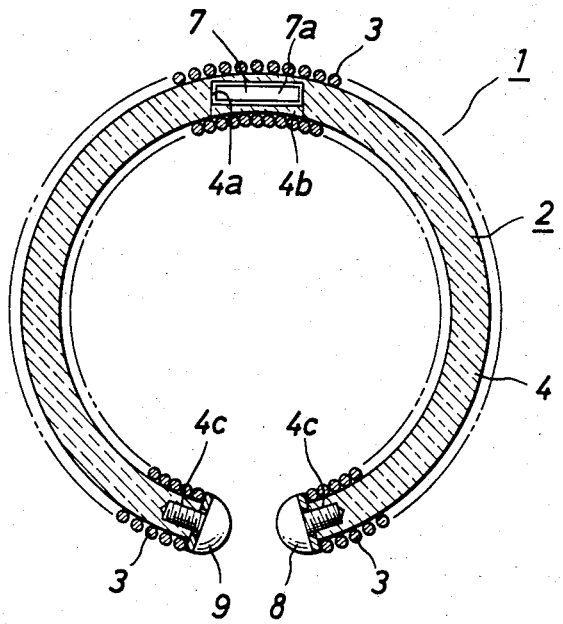
FIG. 2 is a sectional plan of the bracelet type wrist watch of FIG. 1.

FIG. 1 is a perspective view of a digital type wrist watch according to a first embodiment of the present invention, and FIG. 2 is a cross section of the wrist watch of FIG. 1. As shown, the wrist watch 1 is made in the form of a bracelet, and is composed of a coil spring 3 presenting a pleasing appearance and a watch-embedded open-looped body 2 enclosed in the coil spring 3, with the face of the watch covered by the coil spring 3. A gold or silver plated metal coil may be used as presenting a pleasing appearance. Green or red colored resin coils or metallic luster resin coils may be used for presenting a fashionable appearance. The open-looped body 2 is composed of a curved body 4 which is made of a transparent synthetic resin material and has a recess **4*a* made for accommodating a watch module 7. As shown, the watch module 7 is embedded in the recess 4*a* and is sealed with a lid 4*b*. Two end caps 8 and 9 are screwed in corresponding threaded holes 4*c* which are made in the opposite ends of the open-looped body 2. Thus, the coil spring 3 is prevented from slipping out from the open-looped body 2**.

In assembling these components into a bracelet type wrist watch, first a watch module 7 is put and fixed in the recess **4*a* of the open-looped body 4 and then the watch module 7 is sealed by the lid 4, thus completing the watch-embedded open-looped body 2. Then, the open-looped body 2 is pushed in the tubular space defined by a corresponding length of the coil spring until the whole body 2 is completely enclosed in the coiled spring 3. Finally, two end caps 8 and 9 are screwed into the threaded holes 4*c*** made in the opposite ends of the open-looped bracelet.

When wearing the bracelet wrist watch 1, the loop hole is opened wide enough to allow the wrist to pass through the open loop thus expanded.

When desired, the watch module 7 may be taken out from the recess of the open-looped body 2 by stretching the overlying part of the coil spring and by displacing adjacent turns wide enough to permit the passing of the watch module, for instance, for the purpose of renewing a cell. Also, when desired, the coil spring 3 may be changed without difficulty.

As is shown in FIG. 2, the face of the watch module 7 is enclosed with the coil spring loop 3, and normally it remains invisible. When glancing at the time, the part of the coil spring 3 overlying the face of the watch module 7 is stretched the fingers to open adjacent turns wide enough to expose the face of the watch module 7.

Figure 3:
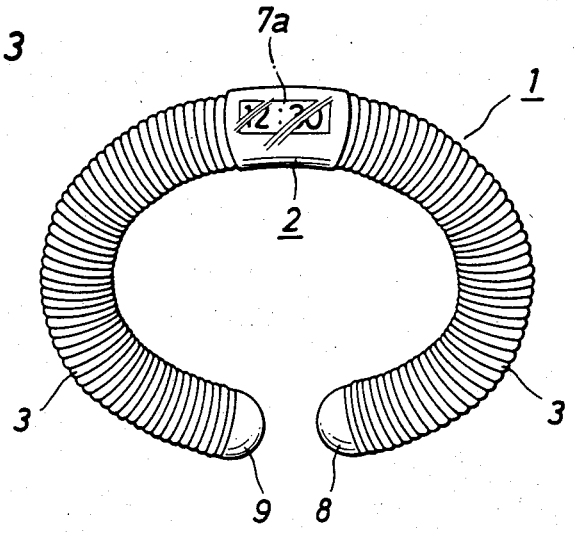
FIG. 3 is a perspective view of a bracelet type wrist watch according to a second embodiment of the present invention.
Figure 4:
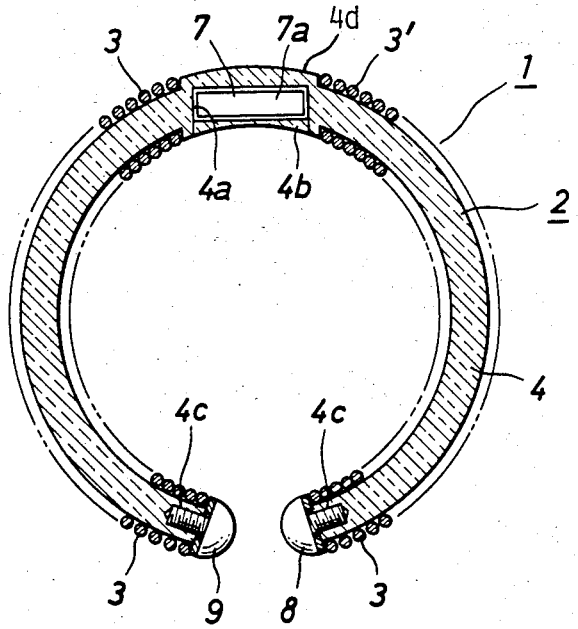
FIG. 4 is a sectional plan of the bracelet type wrist watch of FIG. 3.

FIGS. 3 and 4 show a bracelet type wrist watch according to a second embodiment of the present invention. As shown, the wrist watch 1 is made in the form of an open-looped bracelet, and is composed of two coil springs 3 and 3' and a watch-embedded open-looped body 2 enclosed in these coil springs, although the face of the watch is exposed.

The open-looped body 2 is made of a transparent synthetic resin material, and is composed of a diametrically increased portion 4*d* having a recess 4*a* made for accommodating a watch module 7, and two diametrically decreased portions integrally connected to and extending from the opposite ends of the diametrically increase portion 4*d*. As shown, the watch module 7 is embedded in the diametrically increased portion 4*d*, and is sealed with a lid 4*b*. Two end caps 8 and 9 are screwed in corresponding threaded holes 4*c*, which are made in the opposite ends of the open-looped body 2. Thus, the coil springs 3 and 3' are prevented from slipping out from the open-looped body 2. As is best shown in FIG. 4, the face of the watch is not covered by the coil spring bracelet.

In assembling, the watch module 7 is put in the recess 4*a* of the open-looped body 4, and then the watch module 7 is sealed by the lid 4*b*, thus completing the watch-embedded, open-looped body 2. Then each diametrically decreased portion of the open-looped body 2 is pushed into the tubular space defined by a corresponding length of coil spring until these diametrically decreased portions are completely enclosed in coil springs 3 and 3'. Finally, two end caps 8 and 9 are screwed into the threaded holes 4*c* made in the opposite ends of the open-looped bracelet 2.

When wearing the bracelet wrist watch 1, the loop hole is opened wide enough to allow the wrist to pass through the open loop thus expanded.

Figure 5:
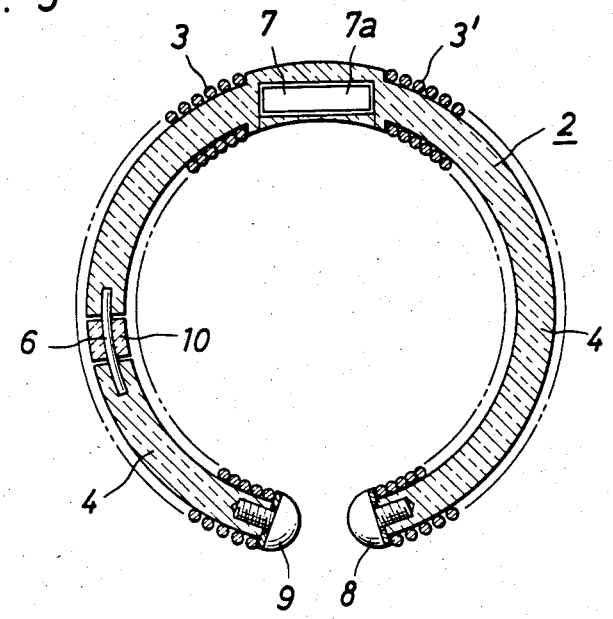
FIG. 5 is a sectional plan of a bracelet type wrist watch according to a third embodiment of the present invention.

FIG. 5 shows a sectional plan of a bracelet wrist watch according to a third embodiment of the present invention. The bracelet wrist watch is different from that of FIGS. 3 and 4 only in that one of the diametrically decreased portions is composed of two separate sections and an intervening resilient spacer 10, connected together by a plate spring 6. This arrangement makes the bracelet easy to open wide when wearing round the wrist. Specifically, the free ends of the open loop are pulled apart from each other by fingers, yieldingly deforming the plate spring 6 and allowing the wrist to pass through the so wide-opened loop. The open loop resiliently restores to its original stress-free position when removing the fingers from the end caps 9, thus fitting the wrist.

Figure 6:
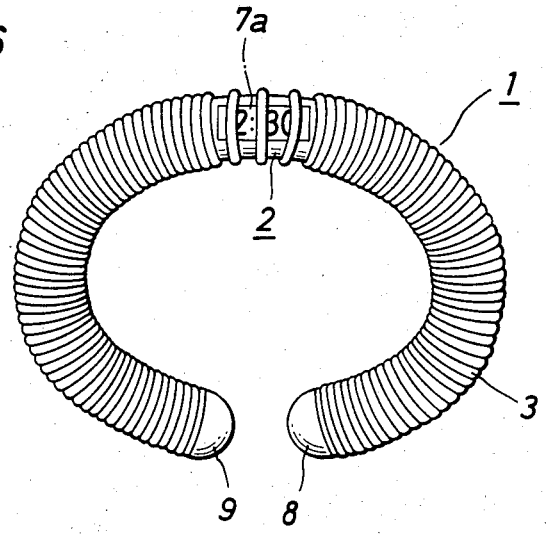
FIG. 6 is a perspective view of a bracelet type wrist watch according to a fourth embodiment of the present invention.
Figure 7:
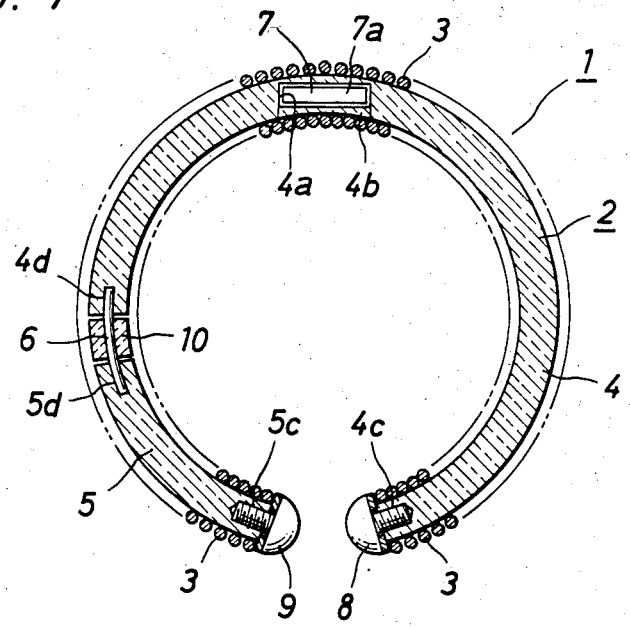
FIG. 7 is a sectional plan of the bracelet type wrist watch of FIG. 6.

Thanks to the use of a plate spring 6, the open loop body can be made of a rigid material. FIGS. 6 and 7 show a bracelet wrist watch according to a fourth embodiment of the present invention.

The bracelet wrist watch is different from that of FIG. 5 only in that the open loop 2 has no diametrically increased portion.

Figure 8:
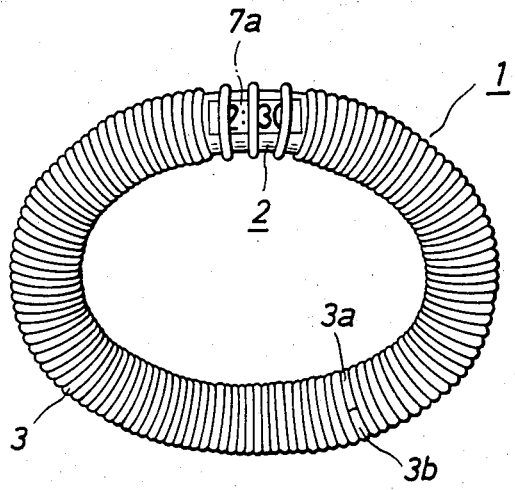
FIG. 8 is a perspective view of a bracelet type wrist watch according to a fifth embodiment of the present invention.
Figure 9:
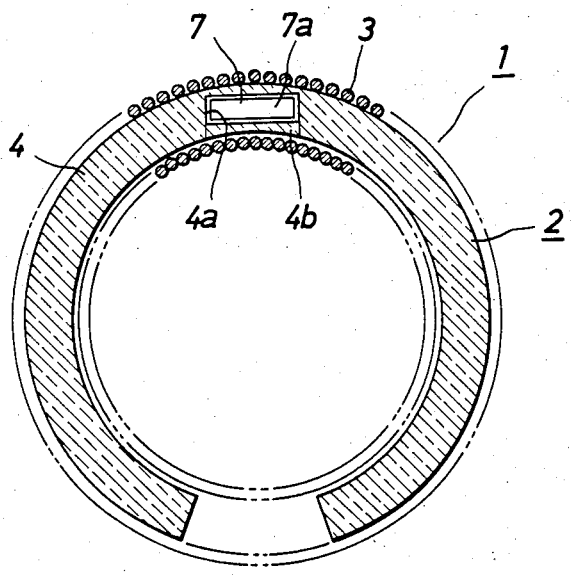
FIG. 9 is a sectional plan of the bracelet type wrist watch of FIG. 8.

FIGS. 8 and 9 show a bracelet type wrist watch according to a fifth embodiment of the present invention. The bracelet wrist watch of this embodiment is different from the first embodiment of FIGS. 1 and 2 only in that the opposite ends 3*a* and 3*b* of the coil spring 3 are connected with each other.

When wearing the bracelet wrist watch 1 around the wrist, the open part of the open-looped body 2 and the corresponding part of the coil spring 3 are stretched to allow the wrist to pass through the enlarged loop.

Figure 10:
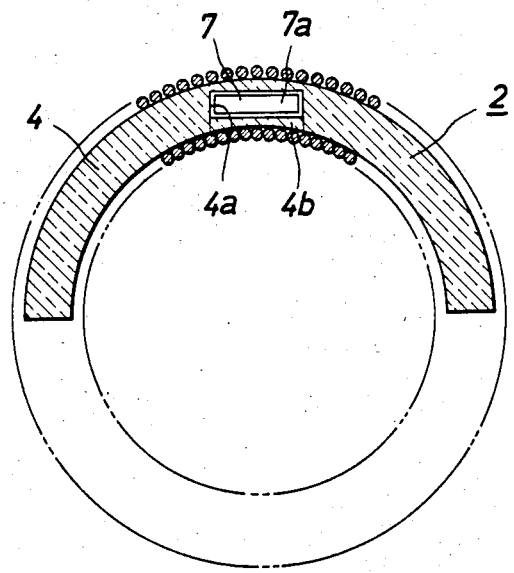
FIG. 10 is a sectional plan of the bracelet type wrist watch according to a sixth embodiment of the present invention.

FIG. 10 shows a sixth embodiment of a bracelet type wrist watch according to the present invention.

The wrist watch of this embodiment is different from that of FIGS. 8 and 9 only in that the open-looped body 2 is in the form of semicircle and makes it easy to spread the coil spring 3 when it is desired to wear the wrist watch on the wrist.

Figure 11:
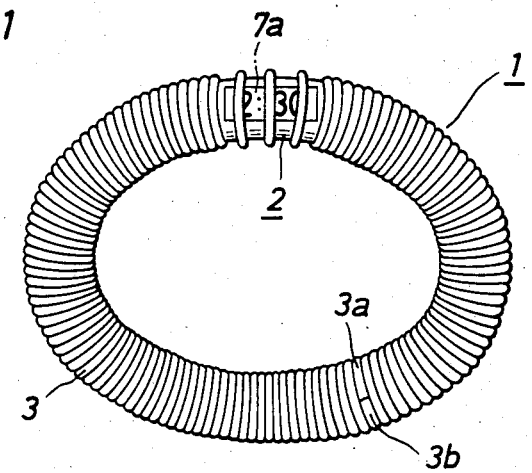
FIG. 11 is a perspective view of a bracelet type wrist watch according to a seventh embodiment of the present invention.
Figure 12:
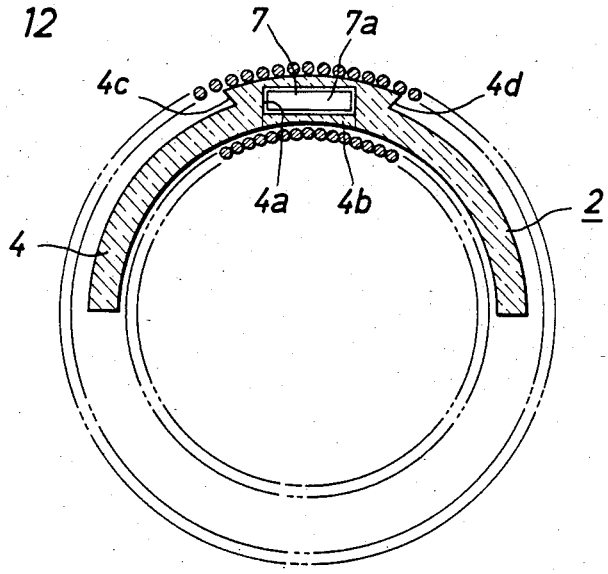
FIG. 12 is a sectional plan of the bracelet wrist watch of FIG. 11.
Figure 13:
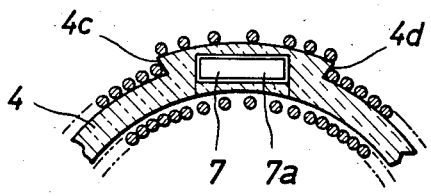
FIG. 13 is sectional plan of a part of the semicircular body shown in FIG. 12 in which a watch module is embedded.

FIGS. 11, 12 and 13 show a bracelet type wrist watch according to a seventh embodiment of the present invention. The bracelet wrist watch is similar to the one which is shown in FIG. 10 except for detents 4*c* and 4*d* provided on the semicircular body 2 at either side of the face 7*a* of a watch module 7. The face 7*a* of the watch module 7 is normally enclosed in the coil spring 3. When glancing at the time, the part of the coil spring 3 overlying the face 7*a* of the watch module 7 is stretched the fingers to open adjacent turns wide enough to expose the face 7*a* of the watch module 7.

When it is desired that the face 7*a* of the watch module 7 be kept visible or partly exposed, the overlying turns are kept separated by an amount wide enough to expose the underlying face 7*a* of the watch module 7 by catching appropriate turns on the detents 4*c* and 4*d* of the semicircular body 2, as is best shown in FIG. 13. Thus, the bracelet wrist watch is kept in the watch-exposed condition. Simply by releasing these turns of the coil spring from the opposite detents of the semicircular body 2 the bracelet wrist watch can be brought to the watch-concealed condition in which it looks like an ornamental ring round the wrist.

Every embodiment is described as using a round coil spring. It however, should be understood that a coil spring whose cross-section is square, triangular or any other geometrical figure may be used.

Though the watch module and the cell are embedded as a single unit in the open-looped body in the embodiments as above described, they may be embedded as separate units in the body.

It is also to be noted that a watch module according to the invention may be of not only the digital type as shown but also the analogue type.

What is claimed is:

1. A bracelet type wrist watch comprising:

a curved body having a watch module embedded therein; and a coil spring having an outer dimension which is greater than the outer dimension of said curved body enclosing at least part of said curved body including said watch module, the portion of said coil spring enclosing said watch module being movable to at least a first position wherein said portion of the coil spring is compressed to cover said watch module and a second position wherein said portion of the coil spring is expanded to permit viewing of said watch module.

2. A bracelet type wrist watch according to claim 1, wherein the opposite ends of said coil spring are connected together to form a closed loop.

3. A bracelet type wrist watch according to claim 1, wherein said curved body is made of an elastic material and is in the form of an open loop.

4. A bracelet type wrist watch according to claim 3, wherein said curved body has an end cap detachably fixed to at least one free end thereof, said coil spring being retained on said curved body by said end cap.

5. A bracelet type wrist watch according to claim 3, wherein said curved body has a discontinuous resilient portion, thereby permitting said curved body to yieldingly open wide by pulling the free ends of the open loop apart from each other.

6. A bracelet type wrist watch according to claim 1, wherein said curved body is composed of a first section containing said watch module and two second sections having diameters which are less than that of said first section integrally connected to and extending from the opposite ends of said first section.

7. A bracelet type wrist watch according to claim 6 wherein said coil spring is larger in diameter than said second sections but smaller in diameter than said first section.

8. A bracelet type wrist watch comprising a curved body having a first section containing a watch module and a second section having a diameter which is less than the diameter of said first section, said first section having detents at the opposite lateral ends of said watch module; and said second section having means for widening said curved body to permit insertion of a users wrist in a loop formed by said first and second sections; and a coil spring enclosing at least part of said curved body, an end of said coil spring pressing against one of said detents thereby enabling a part of said coil spring to be maintained in a stretched condition.

9. A bracelet type wrist watch according to claim 8, wherein two of said second sections are provided, said second sections being integrally connected to and extending from the opposite ends of said first section, and said two detents are provided at the transition from said first section to said second sections, the outer dimension of said coil spring being equal to the outer dimension of the first section of said curved body.

* * * * *

UNITED STATES PATENT AND TRADEMARK OFFICE

CERTIFICATE OF CORRECTION

PATENT NO. : 4,627,739

DATED : December 9 , 1986

INVENTOR(S) : Shingo ICHIKAWA ET AL.

It is certified that error appears in the above-identified patent and that said Letters Patent is hereby corrected as shown below: Title page:

Line "[75] Inventors: Ichikawa Shingo; Hisahide" should be

-- [75] Inventors: Shingo Ichikawa; Hisahide --.

Signed and Sealed this

Tenth Day of March, 1987

*Attest:*

*Attesting Officer*

DONALD J. QUIGG

*Commissioner of Patents and Trademarks*